United States Patent [19]

Updike

[11] 4,227,493

[45] Oct. 14, 1980

[54] VALVE ROTATOR

[75] Inventor: Stanley H. Updike, Painesville, Ohio

[73] Assignee: TRW Inc., Cleveland, Ohio

[21] Appl. No.: 10,461

[22] Filed: Feb. 7, 1979

[51] Int. Cl.[3] ..... F01L 1/32

[52] U.S. Cl. ..... 123/90.3

[58] Field of Search ..... 123/90.3, 90.28, 90.29

[56] References Cited

U.S. PATENT DOCUMENTS

| | | | |
|---|---|---|---|
| 3,421,734 | 1/1969 | Updike | 123/90.3 X |
| 3,710,768 | 1/1973 | May | 123/90.3 |

*Primary Examiner*—Harry N. Haroian

[57] ABSTRACT

A valve rotator for a valve in an internal combustion engine. The rotator has a body and a cap which surround the valve stem and are movable toward and away from each other. Coacting with the cap and the body are a spring washer for transferring axial load from the cap to the body, and a shiftable element or elements carried in one or more pockets in the body and in contact with the spring washer. A fulcrum is provided for shifting the load from the shiftable element directly to the body whereby the shiftable element is reset for effecting rotation when the load on the spring washer is reapplied to the shiftable element.

The technical advantage of the present invention is that a much simpler, less expensive structure capable of smaller axial dimension than prior commercial structures is provided for a rotator operable on the valve closing stroke.

17 Claims, 15 Drawing Figures

VALVE ROTATOR

BACKGROUND OF THE INVENTION AND PRIOR ART

The present invention relates to a valve rotator and more particularly to a rotator for a valve in an internal combustion engine, particularly a diesel engine. Such devices are also finding increasing use in spark ignited engines.

Valve rotators for rotating internal combustion engine valves achieve two purposes. The first of these is to rotate the valve, particularly exhaust valves, so that the hot exhaust gases directly impinge on a different portion of the valve face on each stroke. This minimizes burning of the valve and consequent loss of compression, and extends the lift of the valve and valve seat. Whereas it was not uncommon to rebuild diesel engines after 75,000–100,000 miles of use, the current demand is that the engine should not require rebuilding for any reason prior to 300,000 miles of use. The use of valve rotators aids in the achievement of improved engine life through their beneficial effect on the valves and valve seats.

Typical examples of prior art valve rotators which rotate the valves on the valve opening stroke will be found in the patent to Updike U.S. Pat. No. 4,094,280, the patents to Tauschek U.S. Pat. Nos. 3,952,713, 4,003,353, and 4,075,987, the patent to Orent U.S. Pat. No. 3,537,325, the patents to Norton U.S. Pat. Nos. 2,516,795 and 2,761,434, and the patent to Thorne U.S. Pat. No. 2,624,323.

Another type of valve rotator is utilized not only for the purpose of presenting a different surface for the hot gases upon each cycle, but also for the purpose of cleaning the valve seat by effecting rotation of the valve face against the seat at the time of closing. These rotators operate upon the valve closing stroke and wipe deposits, such as carbon deposits away from the valve seat to be blown out of the combustion chamber by the rush of exhaust gases, for example, or by the in-rush of fuel air mixture.

An example of a valve rotator which operates on the valve closing stroke is shown in the patent to May U.S. Pat. No. 3,710,768.

Other references of interest in the field of valve rotators include the patents to Schonlau U.S. Pat. No. 3,890,943, Enke U.S. Pat. No. 3,717,133 Dooley U.S. Pat. No. 2,935,058, Geer U.S. Pat. No. 2,827,886 and Newton U.S. Pat. No. 2,582,060. Lash adjusters which cause valve rotation in both directions (clockwise and counterclockwise) are shown by Leake U.S. Pat. No. 2,875,740. Witzky U.S. Pat. No. 2,775,232 shows a different type of device utilizing an offset rocker arm. Sward U.S. Pat. No. 2,662,511 shows a combined rotator and lash adjuster.

It will be observed from a review of the prior art structures that each is characterized by basic elements including a rotator body, a rotator cap, shiftable element or elements which coact between the cap and the body, and, with the exception of the lash adjusters, a spring washer, e.g., a Belleville washer. The valve spring is usually seated with one of its ends in engagement with the rotator cap. The rotator body usually rests on the cylinder head. The shiftable elements may be either a side loaded coil type garter spring, or a series of steel balls carried in individual circumferentially extending pockets each having a sloping ramp along which the balls move. To bias the balls toward the upper end of the ramp there are provided individual coil springs. The balls project above the surface of the rotator body at each position along the ramp for contact with the spring washer. The spring washers in such prior art devices are arranged so that one peripheral edge of the washer is in contact with the cap, and the other peripheral edge is normally in contact with the body of the rotator. The ball raceway is located between the peripheral edges of the spring washer.

As the load is increased on the balls by increasing the valve spring load during opening of the valve with a rocker arm, the rotator cap is moved toward the rotator body and the balls forced down the ramps overcoming the bias of the coil springs. Movement of the balls down the ramp causes the spring washer to rotate relative to the frictionally held rotator body. Movement of the washer about the valve axis transmits a rotatory motion to the cap with which it is frictionally engaged. The valve spring which is seated against a retainer near the distal extremity of the valve is rotated because of its frictional engagement with the rotator cap. The rotational movement of the valve spring is transmitted to the valve through the retainer which is locked to the valve stem. When the valve reseats, it is in a different angular position from what it was when the cycle began. Valve rotators, as distinct from lash adjusters, effect a net positive rotation in a predetermined direction during the valve opening and closing cycle. To achieve net positive rotation in one direction a, one way clutch system is utilized to inhibit counter-rotation. In these valve opening rotators, the rotator body and rotator cap are located on opposite sides of the spring washer.

The patent to May, supra, explains the operation of a device which operates on the valve closing stroke. In FIGS. 1 and 2 are shown commercial structures which operate on the valve closing stroke and which are characterized by a plurality of spring washers, and a bearing race. In these valve closing rotators, the rotator body and rotator cap are located on the same side of the spring washer.

It is a primary object of the present invention to simplify the prior art structures operable on the valve closing stroke, and particularly those shown in FIGS. 1 and 2, by eliminating parts and to make them less expensive to manufacture. The improved structures hereof can also have a smaller axial dimension, and are less susceptible to fouling by dirt. To achieve these ends a rotator body having a structure like that normally used in the fabrication of a valve rotator operable during the opening stroke may be modified by the provision therein of a "fulcrum". The fulcrum transfers the valve spring load normally proceeding from the cap through the spring washer and the shiftable element or elements to the body of the rotator, to a condition where the load proceeds from the cap to the spring washer and directly to the body. The load is thus relieved from the shiftable element or elements and the cap and body frictionally clutched against relative rotation by the spring washer. Release from the load on the shiftable element or elements allows the shiftable means to "shift" to a different position relative to the cap and body parts (for example, the balls are forced up the ramp). When the valve spring load is reapplied to the shiftable means from the spring washer as the cap and body move relatively apart, and the spring washer comes off the "fulcrum", the shiftable means is contacted thereby under a heavy load and is displaced in the opposite direction (for example, the balls are forced down the ramp). This causes declutching of the cap and body and enables relative rotation between the cap and the body as will be hereinafter more particularly described.

The provision of means for releasing the load on the shiftable element or elements during a valve stroke to enable such element or elements to assume a different position, distinguishes the present invention from the prior art.

BRIEF STATEMENT OF THE INVENTION

Briefly stated, the present invention is in the provision of an improved valve rotator for a valve in an internal combustion engine which valve is reciprocable between open and closed positions along its longitudinal axis and rotatable about said axis. The rotator includes first and second parts which are movable axially relative to one another in response to forces which alternately increase and decrease. Means are provided for imparting relative rotation between the first and second parts upon relative axial movement of the parts. This structure includes shiftable elements located in a pocket or pockets in one of the parts. A spring washer is provided which surrounds the longitudinal axis of the valve stem. The spring washer is normally in contact with the shiftable element or elements and transmits axial load between the parts and through the shiftable elements. Structure is provided between one of the parts and the spring washer to effect release of the load on the spring washer from the shiftable element or elements during at least a portion of the distance of relative movement of the parts to enable the shiftable element or elements to assume a different position.

In a more specific embodiment of the invention, the structure which coacts between the part and the washer to effect release of the load is a "fulcrum" over which the spring washer is rocked during movement of the parts toward or away from one another and whereby the load on the spring washer is released from the shiftable elements to permit such element or elements to assume a different position between the parts while the parts are clutched together against relative rotation. On relative movement of the parts in the opposite direction, the load is reapplied to the element or elements now in the different position thereby forcing the element or elements back and simultaneously effecting relative rotation between the parts, which are now in a declutched condition.

The fulcrum may be integral with one of the parts, e.g., the body of the rotator, or may be a separate element interposed between one of the parts and the spring washer, e.g. a separate ring. The fulcrum is located intermediate the inside and outside peripheries of the spring washer and is preferably located midway between the inside and outside peripheries of the spring washer.

BRIEF DESCRIPTION OF THE DRAWINGS

The present invention may be better understood by having reference to the annexed drawings showing preferred embodiments of my invention and commerical examples of the prior art, and wherein:

FIG. 3A is a detail of FIG. 3 on an enlarged scale, showing a fulcrum structure integral with the rotator body.

DETAILED DESCRIPTION OF THE DRAWINGS

Figure 1:
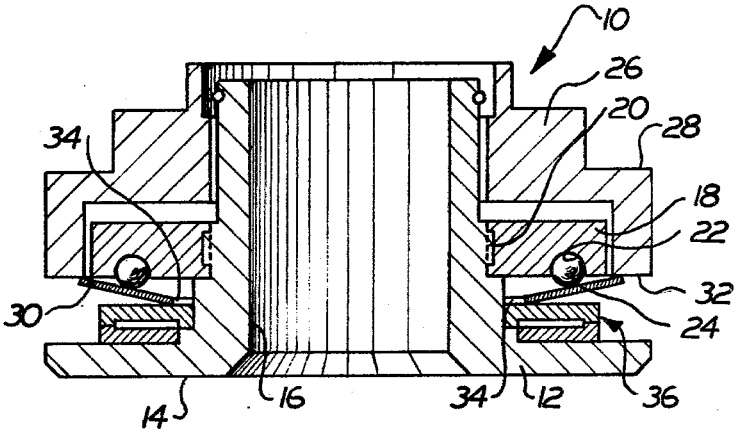
FIG. 1 (PRIOR ART)
FIG. 1 shows in cross section one form of a commerical structure operable on the valve closing stroke.
Figure 2:
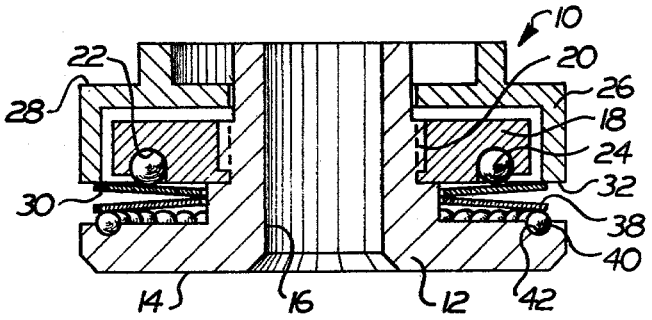
FIG. 2 (PRIOR ART)
FIG. 2 shows in cross section another commerical rotator also operable on the valve closing stroke.

Referring now more particularly to the prior art structures shown in FIGS. 1 and 2, there are here shown commercially available rotators in cross section. The illustrated rotators are operable on the valve closing stroke. The valve rotators 10 each include a body portion 12 adapted to be seated on its lower surface 14 on a cylinder head. The body 12 is provided with an axial bore 16 dimensioned to surround a valve stem and, in most cases, a valve guide portion. The body portion 12 is provided with a collar 18 keyed thereto by a key member such as projection 20 to prevent relative rotation between the collar 18 and the body portion 12. The collar 18 is provided with a series of pockets 22 circumferentially disposed thereabout, each pocket including a shiftable member, for example a ball 24. The pockets 22 are provided with a ramp surface (not shown) which controls the extent of projection of the ball out of the plane of the lower surface of the collar 18.

The structures shown in FIGS. 1 and 2 are also provided with a cap 26 which is movable in an axial direction relative to the body portion 18, and is also rotatable about the axis of the valve stem. The cap portion 26 serves as a seat for the valve spring which rests against the surface 28, and exerts a variable force on a spring washer 30 with which the lower lip 32 is in frictional contact. The rotators of FIGS. 1 and 2 effect rotation of the valve by means of rotating the valve spring (not shown) which in turn rotates the valve spring retainer locked to the distal extremity of the valve stem. Hence, when rotation of the cap 28 of the rotator 10 is effected the valve is caused to rotate. The spring washer 30 must also rotate. Because of its frictional engagement with the lower lip or edge 32, it has been found necessary to mount the inner periphery 34 on a suitable bearing means generally indicated at 36 to enable such rotation. In FIG. 1 the bearing 36 is a roller bearing and race. In FIG. 2, the bearing means consists of a second spring washer 38 mounted on a series of roller balls 40 carried in a suitable circumferential ball race 42. The cap 26 and the body 12 are each on the same side of the spring washer 30.

The prior art structures of FIGS. 1 and 2 are commercially available and operate substantially in the manner taught by May in U.S. Pat. No. 3,710,768. It is structures such as these that are simplified, made less costly, and with smaller axial dimension.

One internal combustion engine of relatively small size had a restricted valve spring space and could not accept as a replacement for a conventional valve opening rotator a valve closing rotator of the type shown in FIGS. 1 and 2. It would accept a structure of the present invention having the smaller axial dimension. The valve closing structures of this invention have the advantage of being insertable in place of currently used valve opening rotators without necessitating a change in the valve springs to achieve the proper load. The illustrated commercial prior art structures cannot be so substituted without necessitating a change in overall axial height or a change in the valve spring to retain proper loading.

Figure 3A:
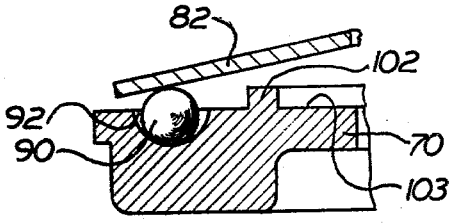
FIGS. 3 and 3A show a fragmentary cross section of a valve assembly including a valve rotator of the present invention which is operable on a valve closing stroke.
Figure 3:
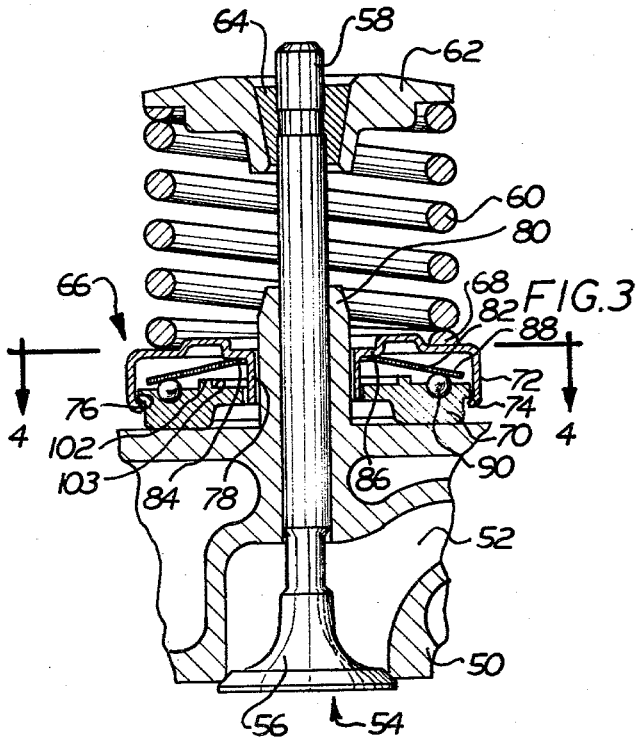

Referring now more particularly to FIGS. 3–8, there is here shown a valve assembly including a rotator for the valve which embodies the present invention. FIG. 3 shows in fragmentary cross section a cylinder head 50 including a valve exhaust port 52. The exhaust port 52 is closed by a valve 54 having a valve head 56 and a valve stem portion 58. In order to bias the valve to a valve closed position such as shown in FIG. 3, there is provided a valve spring 60 seated at one end against a spring retainer 62 locked in a known manner to the distal extremity of the valve stem 58 by means of "keepers" 64. The spring 60 is biased between the cylinder head 50 and the retainer 62. In present invention, a valve rotator assembly generally indicated at 66 is interposed between the cylinder head 50 and the lower end 68 of the valve spring 60. In certain installations, the valve rotator assembly is interposed between the retainer 62 and the upper end of the valve spring 60.

The rotator 66 is composed of a rotator body 70 which is adapted for seating engagement against the cylinder head 50, and a rotator cap 72 which provides a seat for the bottom end 68 of the valve spring 60. The cap 72 is dimensioned for movement in an axial direction relative to the body 70 in response to increase and decrease in load exerted against the cap by the spring 60 as the valve is moved between the open and closed positions by the rocker arm or cam (not shown).

The cap 72 is provided with a lip portion 74 having an inner diameter slightly less than the outer periphery 76 of the body 70. The inner periphery of the cap 72 is provided with a sleeve portion 78 dimensioned for a loose fit around a valve guide portion 80.

As indicated above, the cap 72 and the body 70 are arranged for movement toward and away from each other in response to changes in the load exerted by the spring 60. Interposed between the cap 72 and the body 70, there is a spring washer 82 of the Belleville type for urging the parts 72 and 70 axially apart. The cap 72 and the body 70 are located on opposite sides of the spring washer 82.

Figure 4:
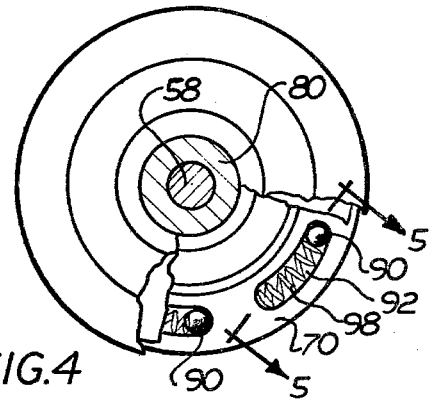
FIG. 4 is a partial cross sectional view, partially cut away and showing the rotator of the present invention as it appears in the plane indicated by the line 4—4 in FIG. 3.
Figure 5:
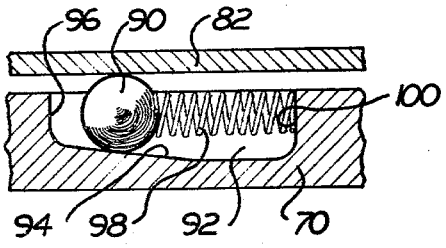
FIG. 5 is a fragmentary cross sectional view on an enlarged scale of a shiftable element, and biasing means therefor as it appears in the plane indicated by the line 5–5 of FIG. 4.

In the embodiment shown in FIG. 3, the inner periphery 84 of the spring washer 82 is located for engagement with the cap 72 under a flange portion 86. The outer peripheral edge portion 88 is adapted for frictional engagement and load transmitting engagement with shiftable elements. As shown in FIG. 3, the shiftable elements include a plurality of circumferentially disposed steel balls 90. As best shown in FIGS. 4 and 5, the steel balls 90 are carried in individual circumferential pockets 92 formed in the upper surface of the body 70. The pockets 92 may be formed by any suitable means, e.g., milling, stamping, forging, etc. The pockets 92 have an arcuate configuration as shown in FIG. 4, and are provided with a ramp portion 94 along which the ball 90 is adapted to roll or slide (FIG. 5). In order to urge or bias the ball 90 toward the shallow end 96, there is provided a coil spring 98 in contact with the ball 90 at one end, and with the end wall 100 of the pocket 92. When the load is released from the spring member 82, as will be described hereinafter, the spring 98 urges the ball 90 up the ramp 94 toward the shallow end 96. In general, from 5 to 7, e.g., 6 of the pockets 92 are provided each containing a shiftable element 90 and biasing spring 98 for returning the element 92 to the shallower end 96 of the pocket 92. The cumulative axial force generated by the biasing springs 98 is less than the minimum force of the alternately increasing and decreasing valve spring forces.

Figure 6:
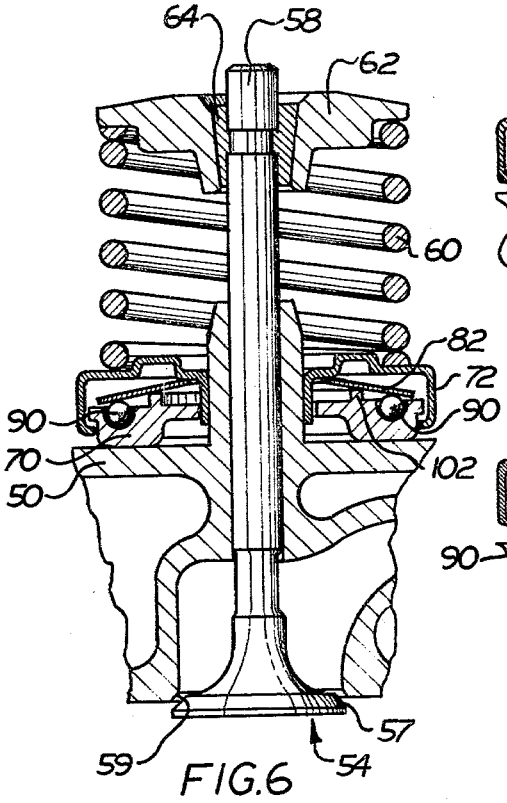
FIG. 6 is a fragmentary cross sectional view of a valve assembly incorporating a valve rotator in accordance with the present invention and showing the condition of the components as the valve begins to open.
Figure 7:
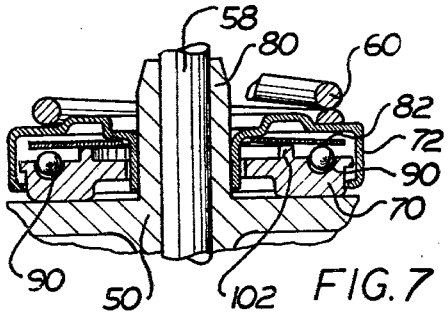
FIG. 7 is a fragmentary cross sectional view of the rotator as shown in FIG. 6 and showing a further condition of the components during reciprocation of the valve.
Figure 8:
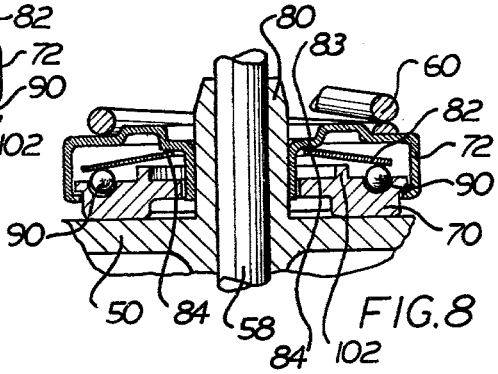
FIG. 8 is a fragmentary cross sectional view of the rotator structure shown in FIG. 6 just prior to the closure of the valve.

The rotator body 70 in the present invention is also provided with a fulcrum 102 which in the embodiment shown in FIG. 3 is an integral circular rim projecting in an axial direction from the top surface 103 of the body 70. The coaction of the spring washer 82 with the fulcrum rim 102 is best shown in FIGS. 6–8. The outside diameter of the spring washer 82 is greater than the pitch diameter of the ball sockets.

FIG. 6 shows the valve 54 in the valve opening mode as the valve face 57 is lifted off the valve seat 59. In this condition, the load on the valve spring 60 is increased and exceeds the summation of the mean flattening load of the Belleville spring 82 and the combined axial force of the spring 98, and the cap 72 is urged toward the cylinder head 50, on which the rotator body 70 is seated, and toward the body 70. The movement of the rotator cap 72 toward the rotator body 70 decreases the axial spacing between the two parts and forces the spring washer 82 to pivot about the balls 90, and come quickly into contact with the fulcrum or annular rim 102. When the valve rotator is loaded by the cam or rocker arm at or near the valve closed point, i.e., just as the valve begins to open, the spring washer 82 should make contact with the fulcrum stop 102. This contact is shown in FIG. 6. The balls 90 are at the lowest or deepest part of the pocket 92 albeit still projecting above the surface 103 of the body 70 an amount sufficient to enable engagement with the spring washer 82.

In FIG. 7, the axial movement of the cap 72 toward the rotator body 70 is of a sufficient magnitude to release the load imparted by the spring washer 82 on the balls 90 and transfer it to the fulcrum 102. In FIG. 7 the spring washer 82 is shown as being cammed off the surface of the balls 90 by the fulcrum rim 102. This action "clutches" the body 70 to the cap 72 through the spring washer 82 and prevents relative rotation between these parts. Although separation of the spring washer 82 from the balls 90 does not happen in actuality, it is illustrated in this manner for clarity. When the load is released from the balls 90, the springs 98 are free to urge the balls 90 up the ramp 94 to the shallower end 96 of the pocket 92.

In FIG. 8, the balls 90 are now at the point of greatest projection from the pockets 92, i.e., at the shallower end 96 of the pockets 92. As the valve 54 begins to reseat itself in response to movement of the valve actuating cam, the load on the valve spring 60 which is at or near its maximum value is again transferred to the balls 90 (which now project farther from the surface 103) through the spring washer 82 which has now been lifted off the fulcrum or annular rim 102 due to movement apart of the cap 72 and the body 70. This action releases the cap 72 for rotation relative to the body 70. Under the loading conditions now obtaining, the balls 90 are again loaded and are forced from their newly assumed position at the shallow end 96 down the ramp 94. In moving down the ramp the balls overcome the bias of the springs 98, and exert a reaction force on the spring washer 82 tending to rotate the washer 82. This reaction force is transmitted through the frictional contact line 83 at the inner periphery 84 to the portion 86 of the cap 72. The reaction force of the balls being forced to roll down the ramps causes rotation of the spring washer 82 in the direction of the slope 94 (which may be clockwise or counterclockwise). The rotation of the cap 72 is transmitted to the valve spring 60, and from the valve spring 60 to the spring retainer 62 which is locked to the valve stem 58 by the keepers 64. In this manner, the rotational effect of the balls moving along the ramps 94 in the pockets 92 is transmitted to the valve 54.

It will be noted that in the embodiment shown, the rotational effect occurs on the closing stroke of the valve and not on the opening stroke as is usual with structures of this kind. Were it not for the interposition of the fulcrum or annular rim 102, the structure shown in FIGS. 3–8 would operate to effect rotation of the valve 54 on the opening stroke as the cap 72 moved in an axial direction toward the rotator body 70. It will also be noted that a "one way clutch" effect is provided resulting in net positive rotation of the valve in a predetermined direction. The parts so "clutched" are the cap 72, the body 70 and the spring washer 82.

With the exception of the modification of the rotator body 70 to provide the fulcrum rim 102, and the spring constant of the springs 98, the other parts necessary for constructing a valve rotator are the same whether the device is to be utilized as a rotator operable on the valve opening stroke, or a valve rotator operable on the closing stroke. The effect on inventory requirements in supplying both types of valve rotators is evident.

It should be noted that the spring constant of the springs 98 in the normal valve opening rotator is sufficient to exert a cumulative axial force in combination with the spring washer 82 to force the cap 72 and body 70 apart when the valve is closed with the balls 90 located at the shallow end of the pockets 92. In the valve closing rotator, the balls are at the deep end of the pockets when the valve is closed, and the springs 98 are insufficient to move the balls up the ramps and overcome the load of the washer 82 and the valve spring. In the valve closing rotators of this invention, the cumulative axial force of the springs 98 is less than 60%, e.g., about 30%, of the mean flattening load of the spring washer. The spring washer 82 has a mean flattening load sufficient to force the cap 72 and body 70 apart while the balls 90 are at the deeper end of the pockets 92.

Figure 9:
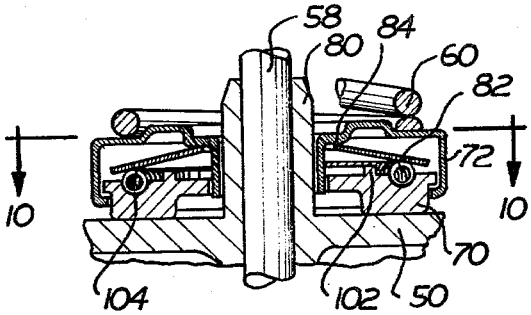
FIG. 9 is a fragmentary cross sectional view showing a rotator in accordance with the present invention using a side loaded garter type coil spring as the shiftable element.
Figure 10:
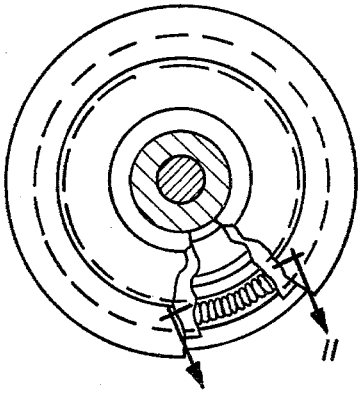
FIG. 10 is a cross sectional view of the assembly shown in FIG. 9 with the cap of the rotator partially cut away to show the garter type coil spring.
Figure 11:
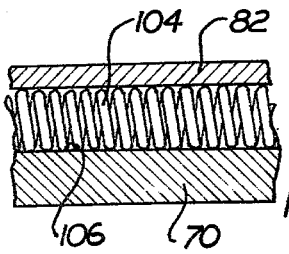
FIG. 11 is a cross sectional view on an enlarged scale of the apparatus shown in FIG. 10 as it appears in the plane indicated by the line 11—11.

The principles of the present invention can also be embodied where the shiftable element instead of being a series of steel balls 90 carried in individual arcuate circumferentially spaced pockets 92, is a side loaded coil type garter spring 104. The spring 104 is carried in a circumferential groove 106 milled into the upper surface 84 of the rotator body 70. The mode of operation of the rotator illustrated in FIGS. 9, 10 and 11 is essentially the same as the mode of operation of the rotators shown in FIGS. 3–8. However, instead of balls shifting in individual pockets 92, loading of the side loaded coil spring 104 causes the coils of the spring 104 to slope at a more acute angle with respect to the cap 70. As the load on the spring 60 is released, the torsional forces stored in the coil spring 104 bear on the spring washer 82 with a "zero slip" load urging it in a predetermined direction as the spring load is released from the cap 72. Rotation of the valve 54 is effected in the same manner as described above in connection with FIGS. 3–8.

Figure 12:
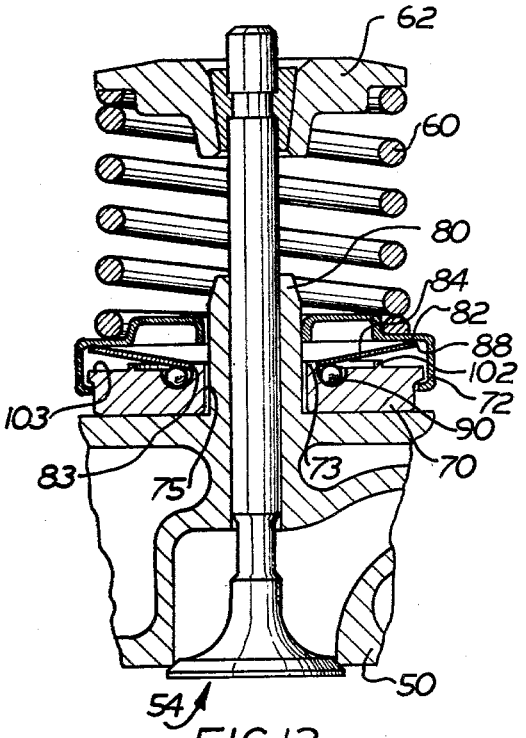
FIG. 12 is a fragmentary cross sectional view of a valve assembly including a modified valve rotator in accordance with the present invention.
Figure 13:
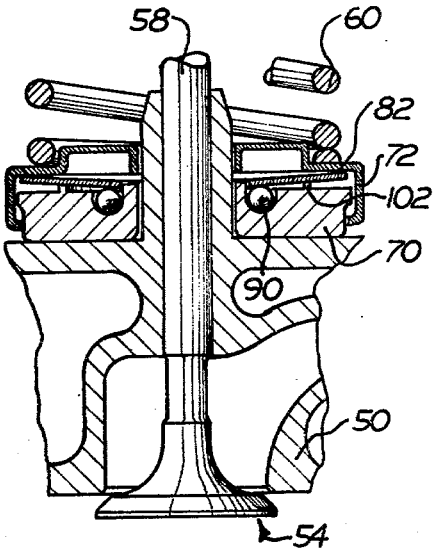
FIG. 13 is a fragmentary cross sectional view of the assembly shown in FIG. 12 where the valve is fully open.
Figure 14:
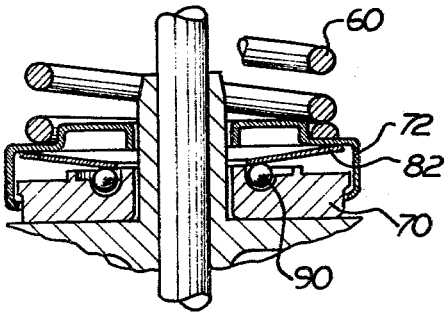
FIG. 14 is a fragmentary cross sectional view of the rotators shown in FIGS. 12 and 13 as the rotator approaches the valve closed condition.

FIGS. 12–14 show another embodiment of the present invention and wherein the shiftable elements, such as the balls 90, are on a smaller radius than the radius of the rim 102. In FIGS. 3–8, the shiftable elements were on a radius larger than the radius of the fulcrum or rim 102. In the embodiment shown in FIGS. 12–14, the spring washer 82 is in a position inverted from that shown in FIGS. 6–8. The balls 90 contact the spring washer 82 at its inner peripheral portion 84, and the outer peripheral portion 88 is in frictional circumferential contact with the cap 72. In order to center the spring washer 82, the inner peripheral edge 82 is seated against an integral collar portion 73 projecting axially toward the cap 72. For ease of assembly, the diameter of the inner face 75 of the rotator body 70 is slightly larger than the external diameter of the valve guide portion 80.

FIG. 13 shows the condition of the system when the valve is in the open position, and the spring washer 82 is engaged with the fulcrum rim 102. In this condition, the load is released from the balls 90, and the springs 98 in the pockets 92 (FIG. 5) are now able to urge the balls toward the shallower end 96 of the pockets 92 in the same manner as set forth in connection with the discussion of FIGS. 3–8. When the load is returned to the balls 90 by movement of the cap portion 72 away from the body portion 70 in response to decreased load exerted by the spring 60, rotation of the washer 82, the consequent rotation of the cap 72, the spring 60, the spring retainer 62 and in turn the valve stem 58, may now occur in the manner described above.

In the structures shown in the annexed drawings, the mean flattening load of the spring washer 82 in the free state must be between the minimum load generated by the valve spring 60 when the valve is closed, and the maximum load generated by the valve spring 60 when the valve is open. The cumulative axial load of the spring washer 82 and the axial component of force of the springs 98 should be in equilibrium with the minimum load generated by the valve spring 60 when the valve is in the valve closed position. If the cumulative axial load is greater, it will tend to compress the valve spring 60 and permit the balls to rise from the bottom of the pockets. The balls 90 initially support the periphery of the spring washer when at the bottom of the pockets 92. The cumulative axial force generated by the spring washer 82 and the summation of the axial forces generated by the springs 98 must be also in equilibrium with the load generated by the valve spring 60 when the valve is fully opened. To prevent the spring washer 82 from deflecting beyond the flat condition when the valve is open, the mean flattening load is designed to be at a level greater than the valve open load when supported on the fulcrum. Preferably the mean flattening load under this condition is about 10% greater than the valve open valve spring load.

In a specific engine test using an IHC V-345E Rig Engine, the valve open load on the valve spring was 190 l bf. and the valve closed load was 63 l bf. The valve spring was a right hand coil spring with a damper. In this engine, valve rotational speeds of about 6 rpm were achieved at a camshaft speed of 600 rpm rising to a maximum of about 9 rpm at 1000 rpm camshaft and declining almost linearly as the camshaft speed was increased to 2000 rpm where about 1.71 rpm of the valve were obtained. In this test, ball return springs 98 were used. Best results were obtained when the cumulative axial force of the ball springs (R4-4-7) on the washer O.D. was about 42 lbf. The spring washer utilized was an RO-551-5 standard spring washer having a mean flattening load of 160 l bf. The balls were 6 in number and 0.1875" diameter. The overall dimension of the rotator was 1.875" diameter.

What is claimed is:

1. A rotator for a valve in an internal combustion engine which is reciprocable between open and closed positions along a longitudinal axis and is rotatable about said axis, said rotator including first and second parts movable axially relative to one another in response to forces which alternately increase and decrease, means for imparting relative rotation between said first and second parts upon relative axial movement of said parts, said means including shiftable means, means defining a pocket in one of said parts for receiving said shiftable means, a spring washer encircling said longitudinal axis and coacting between said first and second parts and in contact with said shiftable means for transmitting axial load between said parts through said shiftable means, and means coacting between said one of said parts and said spring washer to release the load on said spring washer from said shiftable means during at least a portion of the distance of relative movement of said parts.

2. A rotator as defined in claim 1 wherein said spring washer is disposed between said first and second parts.

3. A rotator as defined in any of claims 1 or 2 wherein said load releasing means projects axially from the surface of said one of said parts toward the other of said parts.

4. A rotator as defined in any of claims 1 or 2 wherein said load releasing means is an axially projecting circumferential rim on said one of said parts.

5. A rotator as defined in claim 4 wherein said rim is radially inward of said shiftable means.

6. A rotator as defined in claim 4 wherein said rim is radially outward of said shiftable means.

7. A rotator as defined in any of claims 1 or 2 wherein said shiftable means is a plurality of circumferentially disposed balls each disposed in an individual pocket having an axially sloping ramp along which said ball moves and resilient means coacting between an end wall of said individual pocket and said ball for biasing said ball toward the shallower end of said pocket when the load on said spring washer is released from said shiftable means.

8. A rotator as defined in any of claims 1 or 2 wherein said shiftable means is a 360° side loaded garter type coil spring.

9. A rotator as defined in claim 7 wherein the biasing springs for the balls have a cumulative force which is less than the minimum force of the alternately increasing and decreasing forces.

10. A rotator for a valve in an internal combustion engine which valve has a valve stem and is reciprocable between open and closed positions along the longitudinal axis of said valve stem and is rotatable about said axis during the valve closing stroke, said rotator including a valve rotator body and a valve rotator cap, said cap and body being movable axially relative to one another in response to forces which alternately increase and decrease, means for imparting relative rotation between said body and said cap as said forces decrease and said body and cap move axially away from each other, said rotation imparting means including shiftable means located between said body and said cap, means defining a pocket in said body for receiving said shiftable means, a spring washer encircling said valve stem and interposed between said body and said cap, for transmitting axial load between said cap and said body, one peripheral portion of said spring washer adapted to be in contact with said cap and the other peripheral portion of said spring washer adapted to be in contact with said shiftable means during at least a portion of said valve closing stroke, and means coacting between said body and said spring washer intermediate said peripheral portions to release the load on said spring washer from said shiftable means during at least a portion of the valve stroke when relative movement of the body and the cap toward one another occurs.

11. In an internal combustion engine, a valve reciprocable between an open position and a closed position, a valve seat in a cylinder head, a spring retainer, a valve spring, said valve having a valve body for seating against said valve seat and a longitudinal valve stem having said spring retainer secured to the distal extremity thereof, said valve spring coacting between said spring retainer and the cylinder head to bias said valve to a valve closed position, a rotator for said valve surrounding said valve stem for rotating said valve about the axis of said valve stem during the valve closing stroke, said rotator including a valve rotator body and a valve rotator cap, said cap having an external seat for one end of said valve spring, said rotator cap and said rotator body being movable axially relative to one another in response to forces which alternately increase and decrease, means for imparting relative rotation between said rotator cap and rotator body as said forces decrease and said rotator body and rotator cap move axially away from each other, said rotation imparting means including shiftable means located between said rotator cap and said rotator body, means defining a pocket in said rotator body for receiving said shiftable means, a spring washer having inner and outer peripheral portions encircling said valve stem and interposed between said rotator body and said rotator cap for transmitting axial load between said rotator cap and rotator body through said shiftable means, one peripheral portion of said spring washer adapted to be in contact with said rotator cap and the other peripheral portion of said spring washer adapted to be in contact with said shiftable means during at least a portion of said valve closing stroke, and means coacting between said rotator body and said spring washer intermediate said peripheral portions to release the load on said spring washer from said shiftable means and transferring such load directly to said rotator body during at least a portion of the valve stroke when relative movement of said rotator body and the rotator cap toward one another occurs.

12. In an internal combustion engine as defined in claim 11 wherein the shiftable means are in contact with the outer periphery of said spring washer during at least a portion of the valve closing stroke.

13. In an internal combustion engine as defined in claim 11 wherein the shiftable means are in contact with the inner periphery of said spring washer during at least a portion of the valve closing stroke.

14. In an internal combustion engine as defined in any of claims 11, 12 and 13 wherein the shiftable means is a plurality of circumferentially disposed balls each disposed in an individual pocket in said rotator body, each of said pockets having an axially sloping ramp along which said ball moves and resilient means coacting between an end wall of said individual pocket and said ball for biasing said ball toward the shallower end of said pocket when the load on said spring washer is released from said shiftable means.

15. In an internal combustion engine as defined in any of claims 11, 12 and 13 wherein the shiftable means is a 360° side loaded garter type coil spring.

16. In an internal combustion engine as defined in any of claims 11, 12, or 13 wherein the load releasing means coacting between the rotator body and the spring washer projects axially from the surface of the rotator body toward the rotator cap.

17. In an internal combustion engine as defined in claim 16 wherein the load releasing means is an axially projecting circumferential rim.

* * * * *